United States Patent [19]

Leperre

[11] Patent Number: 4,470,352

[45] Date of Patent: Sep. 11, 1984

[54] CARTRIDGE FOR BULLING MINE HOLES

[75] Inventor: Michel Leperre, Paris, France

[73] Assignee: Societe Bourguignonne d'Applications Plastiques (Societe Anonyme), Quetigny, France

[21] Appl. No.: 338,132

[22] Filed: Jan. 8, 1982

[30] Foreign Application Priority Data

Jan. 19, 1981 [BE] Belgium ..... 1/10101

[51] Int. Cl.[3] ..... F42B 3/00

[52] U.S. Cl. ..... 102/333; 102/313; 299/13

[58] Field of Search ..... 102/333, 313; 299/13, 299/20–23, 95; 166/92; 138/93

[56] References Cited

U.S. PATENT DOCUMENTS

| | | | |
|---|---|---|---|
| 1,097,277 | 5/1914 | Waitz | 166/192 |
| 2,294,521 | 9/1942 | Steadman et al. | 166/192 |
| 2,884,071 | 4/1959 | Fredd | 166/192 X |
| 3,151,556 | 10/1964 | Karpovich | 102/333 |
| 4,194,561 | 3/1980 | Stokley et al. | 166/192 X |
| 4,340,046 | 7/1982 | Cox | 138/93 X |

FOREIGN PATENT DOCUMENTS

| | | | |
|---|---|---|---|
| 878787 | 3/1980 | Belgium . | |
| 949633 | 9/1956 | Fed. Rep. of Germany | 102/333 |
| 382058 | 9/1964 | Switzerland . | |

*Primary Examiner*—Peter A. Nelson

*Attorney, Agent, or Firm*—Spencer & Frank

[57] ABSTRACT

Cartridge for bulling mine holes, which is of cylindrical shape, is made of an elastic material and possesses a zone 7 capable of deforming axially and a zone 6 capable of deforming radially, under the effect of an axial or radial pressure exerted on the cartridge or under the effect of an internal pressure variation, in which cartridge the volume of the zone 7 capable of deforming axially is greater than the volume of the zone 6 capable of deforming radially.

9 Claims, 2 Drawing Figures

CARTRIDGE FOR BULLING MINE HOLES

The present invention relates to a cartridge for bulling mine holes, which is of cylindrical shape, is made of an elastic material and possesses a zone capable of deforming axially and a zone capable of deforming radially, under the effect of an axial or radial pressure exerted on the cartridge or under the effect of an internal pressure variation, and which is intended to be filled with a filler. A cartridge of this type is remarkable by virtue of the fact that it blocks the mine hole perfectly and seals this hole completely during the explosion of the charge introduced into this hole beforehand. Belgian Pat. No. 878,787, filed on Sept. 14, 1979 in the name of the Applicant Company, has already described a cartridge of this type for bulling mine holes.

According to the said patent, it is advisable to choose the number, the dimensions and the shapes of the zones capable of deforming radially or axially, so that the increases or decreases in the volumes corresponding to each of these zones can compensate each other when the cartridge is subjected to pressures and is filled with a fluid or other incompressible material. According to the particular embodiment illustrated in the abovementioned patent, the volume corresponding to the zone of axial deformation is much smaller than the volume corresponding to the zone of radial deformation. However, it has been found that cartridges made in this way do not make it possible to ensure with certainty that the cartridge will block the mine hole during the explosion.

Consequently, the aim of the present invention is to overcome this serious disadvantage of the known cartridge.

It relates to a cartridge for bulling mine holes, which is of cylindrical shape, is made of an elastic material and possesses a zone capable of deforming axially and a zone capable of deforming radially, under the effect of a radial or axial pressure and under the effect of an internal pressure variation, in which cartridge the volume corresponding to the zone capable of deforming axially is greater than the volume corresponding to the zone capable of deforming radially.

In the cartridge according to the invention, the largest diameter of the zone capable of deforming radially is most frequently between 110 and 200% and preferably between 120 and 150% of the largest diameter of the zone capable of deforming axially. Thus, the length of the zone capable of deforming axially must be substantially greater than the length of the zone capable of deforming radially. In general, the ratio of the length of the zone capable of deforming axially to the length of the zone capable of deforming radially is preferably equal to at least 1.5 and preferably more than 2.

According to an advantageous embodiment of the cartridge according to the invention, the zone capable of deforming radially is provided with an even number, preferably equal to at least 8, of longitudinal channels or grooves, the profile of which is triangular and the greatest depth of which is preferably equal to about 25 to 75% of the largest radius of the zone. These channels or grooves can be identical. Preferably, they are distributed uniformly over the periphery of the zone. According to a preferred alternative embodiment, the zone capable of deforming radially is equipped with 8 longitudinal channels or grooves of two different shapes occurring alternately.

The general configuration of the zone capable of deforming radially is arbitrary. In a preferred embodiment, this zone consists of two identical frustoconical portions connected directly by their large base.

The general configuration of the zone capable of deforming axially is also arbitrary, but it is preferably cylindrical and provided with hollow annular channels arranged so as to form a bellows.

Moreover, in addition to the zones capable of deforming radially or axially, the cartridge according to the invention can possess substantially non-deformable zones, the largest transverse dimension of which is less than the largest transverse dimension of the zone capable of deforming radially, preferably by at least 10% and more particularly by at least 20%. These zones can advantageously be cylindrical.

Finally, the cartridge according to the invention possesses, at one end, a closed bottom which can be flat or of rounded shape, and preferably, at the other end, a filling orifice which can be sealed, for filling the cartridge on site before introducing the plug into the mine hole to be sealed. Preferably, the orifice is contiguous to the zone capable of deforming axially.

The cartridge can also be filled at the site of manufacture, in which case it can be closed definitively, for example by welding. Otherwise, the filling orifice can be sealed by any means ensuring good leak-tightness, such as a valve, a cover or a screw-threaded cap, the latter being preferred.

The capacity of the cartridge according to the invention is chosen according to the nominal diameter of the mine hole to be sealed. In general, the total length of the cartridge is between 2 and 15 times, most frequently between 4 and 8 times, its largest transverse dimension.

The material of which the cartridge according to the invention is made is chosen so as to be sufficiently elastic to allow the axial and radial deformations of the zones capable of deforming radially or axially. Preferably, however, it is not too elastic, so that the plugs can be positioned easily. Finally, the material preferably has a sufficient scratch resistance and a low coefficient of sliding friction. In general, thermoplastics are suitable for producing the cartridge according to the invention. Thus, it is possible to use polyolefines such as high-density or low-density polyethylene, polypropylene and copolymers of ethylene and/or propylene, polystyrene, vinylic resins such as rigid or semi-rigid polyvinyl chloride, vinyl chloride copolymers and polyvinylidene fluoride, polyamides, polycarbonates and thermoplastic polyesters such as poly-(ethylene glycol) terephthalate. Good results have been obtained with polyolefines and particularly with polypropylene or polyethylene.

The cartridge according to the invention can be produced by any moulding technique and in particular by blow-moulding starting from extruded tubular blanks or from injection-moulded preforms.

The thickness of the walls is also chosen according to the desired leaktightness. In general, it is between 0.2 and 2 mm.

The invention is explained in greater detail in the description of a particular embodiment thereof, which now follows and is given by way of illustration.

In this description, reference will be made to the figures of the attached drawings in which.

Figure 1:
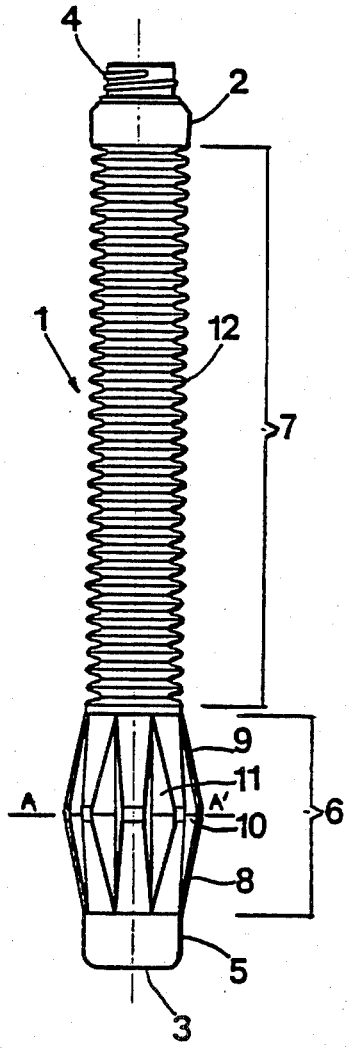
FIG. 1 is a view in elevation of a cartridge according to the invention.
Figure 2:
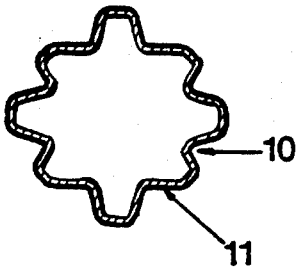
FIG. 2 is a view in section through the cross-section AA' of FIG. 1.

As shown in the figures, the cartridge 1, which has been produced by blow-moulding a portion of a tubular blank made of polypropylene or polyethylene, possesses a side wall 2 of cylindrical shape, a closed bottom 3 of rounded shape and a threaded orifice 4 which can be hermetically sealed by means of a screw-cap which is not shown.

Starting from the bottom 3, the side wall 2 of the cartridge successively possesses a smooth cylindrical zone 5, a zone 6 capable of deforming radially and a zone 7 capable of deforming axially, which is adjacent to the threaded orifice 4. The cylindrical zone 5 is short.

The zone 6, which consists of two identical frustoconical portions 8 and 9 connected by their large base, is provided with 8 channels of two different shapes 10 and 11, distributed alternately.

The zone 7 possesses 32 identical annular channels 12 arranged so as to form a bellows.

According to the invention, the internal volume corresponding to the zone 7 capable of deforming axially is greater than the internal volume corresponding to the zone 6 capable of deforming radially, and the length of the zone 7 is much greater than the length of the zone 6.

The cartridge which has just been described in this way is used in the same way as the cartridge described in Belgian Pat. No. 878,787 for bulling explosive charges placed in mine holes.

The cartridge is filled with a material, such as a liquid, a paste or a powder, which is normally used in this type of plug. For this purpose, it is possible to use water, glycols, mixtures of water and a gelling substance, aqueous solutions of calcium chloride, calcium chloride flakes, or the like. Very good results are obtained with pure water. The cartridge is sealed by means of a threaded cap. The plug is preferably designed to be introduced cap first.

The plug made up in this way is suitable for all mine holes of which the nominal diameter is slightly smaller, for example by less than 10% and preferably by less than 5%, than the largest diameter of the zone 6, and is therefore larger than the diameter of the zone 7 and of the smooth cylindrical zone 5.

The plugs made up by means of the cartridges according to the invention are suitable, inter alia, for any mine blasting in which the explosive charge is placed at the bottom of a hole of circular cross-section, and, because of their high performance characteristics, very particularly in coal mines.

I claim:

1. Cartridge for bulling mine holes, which is of cylindrical shape, is made of an elastic material and possesses a zone (7) capable of deforming axially and a zone (6) capable of deforming radially, under the effect of a radial or axial pressure exerted on the cartridge or under the effect of an internal pressure variation, characterised in that said zones occupy successive axial portions of said cartridge, the volume of the zone (7) capable of deforming axially is greater than the volume of the zone (6) capable of deforming radially, and said cartridge is constructed to be inserted in a mine hole with said zone capable of deforming axially projecting into the hole and said zone capable of expanding radially bearing against the side wall of the hole, and to respond to an explosion in the hole by axial contraction of said zone capable of deforming axially and radial expansion against the hole wall of said zone capable of deforming radially.

2. Cartridge according to claim 1, characterised in that the ratio of the length of the zone (7) capable of deforming axially to the length of the zone (6) capable of deforming radially is equal to at least 1.5.

3. Cartridge according to claim 2, characterised in that the ratio is more than 2.

4. Cartridge according to any one of claims 1 to 3, characterised in that the zone (6) capable of deforming radially is provided with an even number, equal to at least 8, of longitudinal channels or grooves (10), (11) of triangular profile.

5. Cartridge according to claim 4, characterised in that the zone capable of deforming radially is provided with 8 longitudinal channels or grooves (10), (11) of two different shapes occurring alternately.

6. Cartridge according to claim 1, characterised in that the zone (6) capable of deforming radially has a general configuration such that is consists of two identical frustoconical portions (8), (9) connected directly by their large base.

7. Cartridge according to claim 1, characterised in that it possesses a filling orifice (4) which can be sealed and which is contiguous to the zone (7) capable of deforming axially.

8. Cartridge according to claim 1, characterised in that it consists of polyolefine.

9. Cartridge according to claim 1 constituted by a hollow body, and wherein said volumes are volumes of respective portions of the space enclosed by said hollow body and are in pressure transmitting communication with one another.

* * * * *